US009139361B2

(12) United States Patent
Mackie

(10) Patent No.: US 9,139,361 B2
(45) Date of Patent: Sep. 22, 2015

(54) TEMPORARY WALL FOR A RECTANGULAR LIQUID CONTAINMENT SYSTEM AND METHOD OF INSTALLATION

(76) Inventor: Dale Mackie, Victoria (CA)

( * ) Notice: Subject to any disclaimer, the term of this patent is extended or adjusted under 35 U.S.C. 154(b) by 817 days.

(21) Appl. No.: 13/310,956

(22) Filed: Dec. 5, 2011

(65) Prior Publication Data

US 2013/0140304 A1 Jun. 6, 2013

(51) Int. Cl.
*B65D 90/24* (2006.01)
*B65D 90/22* (2006.01)

(52) U.S. Cl.
CPC ..... *B65D 90/24* (2013.01); *B65D 90/22* (2013.01)

(58) Field of Classification Search
CPC ..... B65D 90/22; B65D 90/24
USPC ..... 220/4.01, 4.12, 9.1, 9.2, 9.4, 573, 646, 220/647
See application file for complete search history.

(56) References Cited

U.S. PATENT DOCUMENTS

| | | | | |
|---|---|---|---|---|
| 6,053,666 | A | 4/2000 | Irvine et al. | |
| 2011/0073298 | A1 | 3/2011 | Thompson | |
| 2012/0031899 | A1 * | 2/2012 | Dagesse | 220/62.11 |

FOREIGN PATENT DOCUMENTS

| | | | | |
|---|---|---|---|---|
| CA | 2362105 | | 5/2002 | |
| CA | A2362105 | * | 5/2002 | E04H 17/18 |

* cited by examiner

*Primary Examiner* — Fenn Mathew
*Assistant Examiner* — Elizabeth Volz
(74) *Attorney, Agent, or Firm* — Cameron IP

(57) ABSTRACT

One embodiment of a temporary wall for a rectangular liquid containment system comprises linear and corner panels. The linear panels comprise a rectangular body including a supporting foot apparatus that deploys from the outside surface of the body. A horizontal panel extends from the bottom of the panel inwardly for stability. The linear panels are joined in an overlapping configuration. The corner panels are pinned together at a hinge. An impermeable membrane is laid over a ground surface to be protected against spills and draped over the tops of the linear and corner panels. A metallic cap is placed over the top of the panels to secure the membrane.

13 Claims, 9 Drawing Sheets

TEMPORARY WALL FOR A RECTANGULAR LIQUID CONTAINMENT SYSTEM AND METHOD OF INSTALLATION

CROSS-REFERENCE TO RELATED APPLICATIONS

N/A

FEDERAL FUNDING

N/A

FIELD OF THE INVENTION

This invention relates to static structures and particularly to a temporary wall for a rectangular containment system and method of installation.

BACKGROUND OF THE INVENTION

The following prior art appears relevant: U.S. Pat. No. 6,053,666 "Containment Barrier Panel and Method of Forming a Containment Barrier Wall" issued on Apr. 25, 2000; US2011/0073298 "Environmental Containment and Protection System" published on Mar. 31, 2011 by Timothy Dale Thompson; and CA2362105 "Modular Panel for a Liquid Containment Barrier and a Liquid Containment Barrier" issued to Dale Mackie on 26 Aug. 2003.

Under, national, state, provincial and municipal laws it is a requirement to surround a potentially leaky structure containing toxic substances, such as oil and gasoline, with a bund wall, a dike, an earthen berm or frame supported berm. In the event of a leak or spill, the substance is retained within the enclosure mitigating the contamination of surrounding soil and making clean-up easier.

While the prior art describes a variety of containment systems, there is still a need for a system that is easily transportable by truck to a remote location and easy installed in all types of weather and terrain.

SUMMARY OF THE INVENTION

In accordance with one embodiment of the invention a temporary wall for a rectangular liquid containment system comprises four sides comprising least one linear panel per side and four corner panel sets.

Each linear panel comprises a generally rectangular elongate body panel having a length, a height, a thickness, a top end, a bottom end, a left side edge and a right side edge, an inside surface and an outside surface. The inside surface of each panel is adjacent a containment sealing membrane. A horizontal panel extends inwardly from the bottom of each panel and is perpendicular along the length of the panel.

The top end of each panel is capped with an elongate member or sealing cap member extending along the length of the panel for sealing the top end of the containment sealing membrane to the panels.

A rib member is disposed just inside the right edge of the linear panels and extends from the top end to the bottom end of each panel. This rib member is adapted to abut the left side edge of an adjacent panel when they are slid together in an overlapping relationship. A shorter stiffening rib is disposed on the left side of each panel approximately midway between the top end and the bottom end of each panel.

Each panel has retractable foot apparatus fixed centrally on the outside surface of each of the wall panels and corner panels.

Each of the corner panels in a corner panel set is similarly configured as the linear wall panels except for the pin sleeves on facing sides of the corner panels for receiving a hinge pin.

A method of constructing a rectangular liquid containment system around a central point comprises the steps of:

1. Arranging a plurality of duplicate linear wall panels and four corner panels sets around an area to be enclosed by the rectangular liquid containment system;
2. Forming the four corners of the containment system by pinning each of the first corner panels to an adjacent and perpendicular second corner panel;
3. Deploying the corner panel retractable foot apparatus;
4. Sliding a first linear wall panel left side in an overlapping relationship with a second corner panel right side so that said linear wall panel left side edge abuts the second corner right side rib and so that the second corner panel right side edge engages the stiffening rib of the linear wall panel left side;
5. Deploying the first linear wall panel retractable foot apparatus;
6. Repeating steps IV and V above until a desired wall length is obtained;
7. Placing the containment sealing member within the enclosed area so that the containment sealing member is adjacent the inside surface of the walls;
8. Draping the edges of the containment sealing member over the top edges of the linear wall panels and corner panel sets;
9. Placing the sealing cap member over the top edges.

Advantages

Accordingly, there are several advantages to the present invention over the prior art: the wall panels of the present invention are lighter than the prior art panels and so easier and less expensive to transport; the panels are not fastened together and so can be installed quickly; the foot supports of the panels are integral to the panel design and fold away in a stored configuration lessening installation time. Other advantages of one or more aspects of the invention will be apparent from a consideration of the drawings and ensuing description.

DETAILED DESCRIPTION OF THE INVENTION

Figure 1:
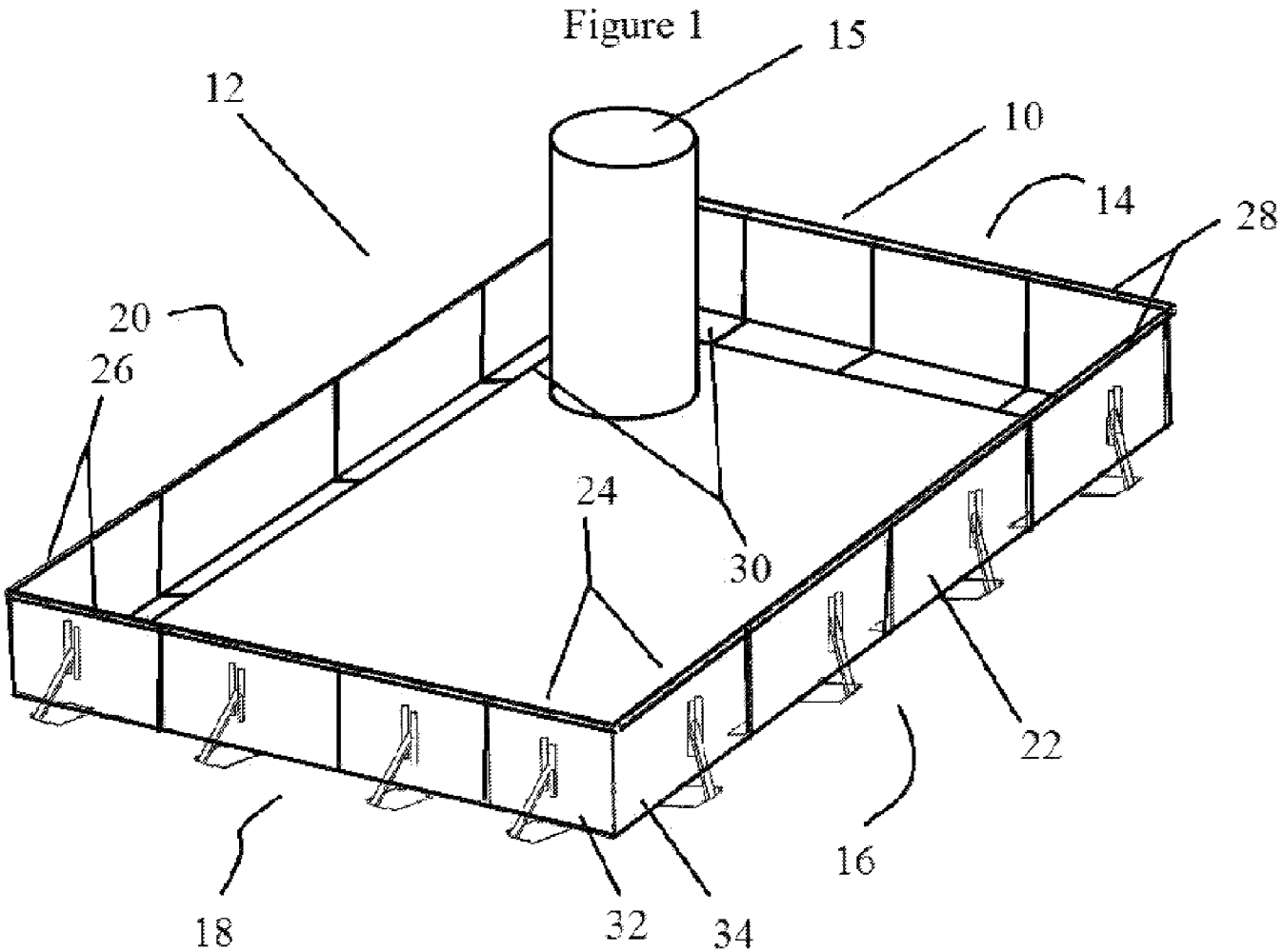
FIG. 1 illustrates a containment system of one embodiment of the invention.

Referring to FIG. 1, the invention is a temporary wall 10 for a rectangular liquid containment system shown generally as 12. One example might be a containment system surrounding an oil tank 15 at a remote pumping location.

The wall comprises four sides 14, 16, 18 and 20. Each wall comprises at least one linear panel 22 per side and four corner panel sets 24, 26, 28 and 30. Each of the corner panel sets comprises a first corner panel 32 and a second corner panel 34.

Figure 2:
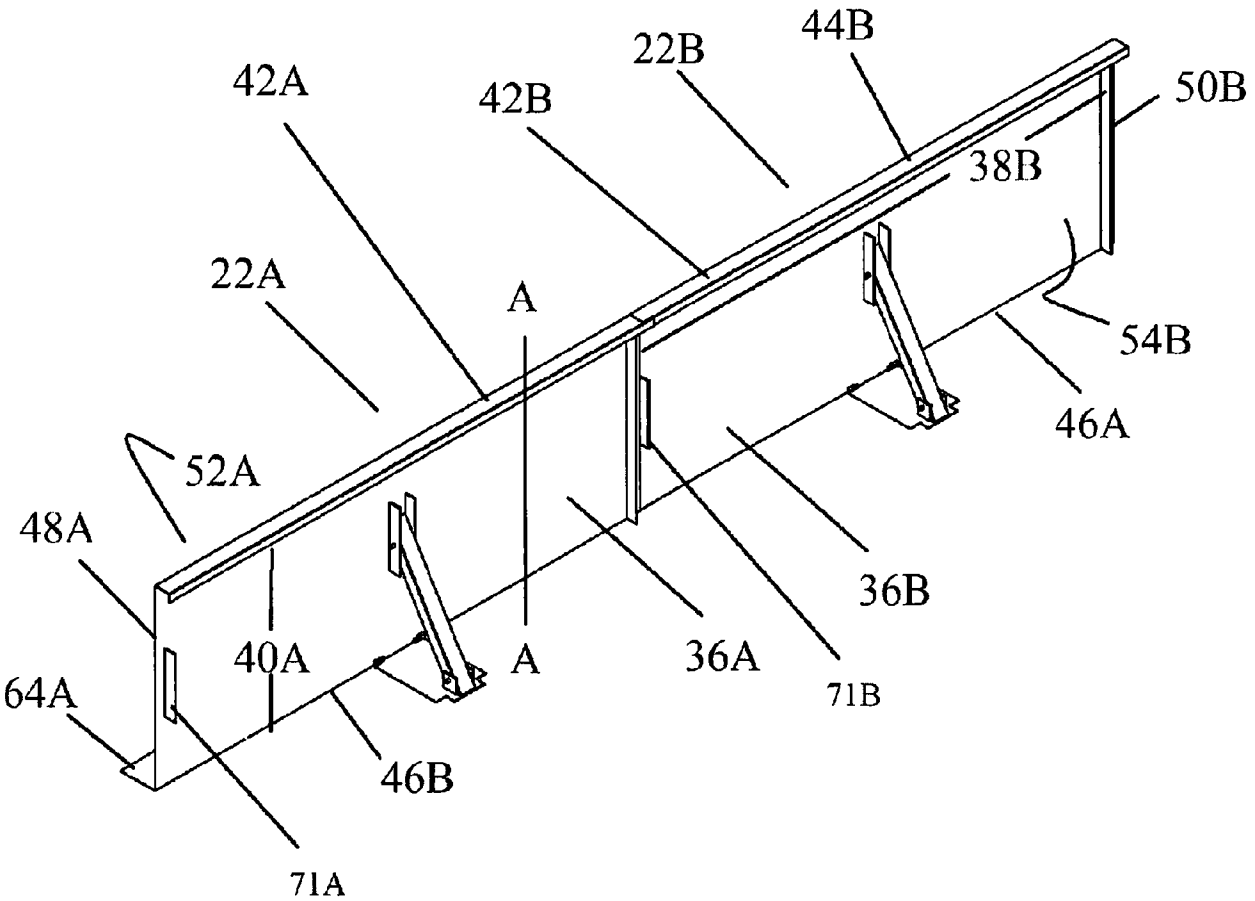
FIG. 2 illustrates pair of linear wall panels of one embodiment of the system.

Refer now to FIG. 2. In FIG. 2, there is illustrated a pair of identical linear wall panels 22A and 22B adjacent to each other in an overlapping configuration. Each of the linear panels 22A and 22B comprise a generally rectangular elongate body 36AB having a length 38AB, a height 40AB, a thickness 42AB (FIG. 3), a top end 44AB, a bottom end 46AB, a left side edge 48AB and a right side edge 50AB, an inside surface 52AB and an outside surface 54AB.

Figure 3:
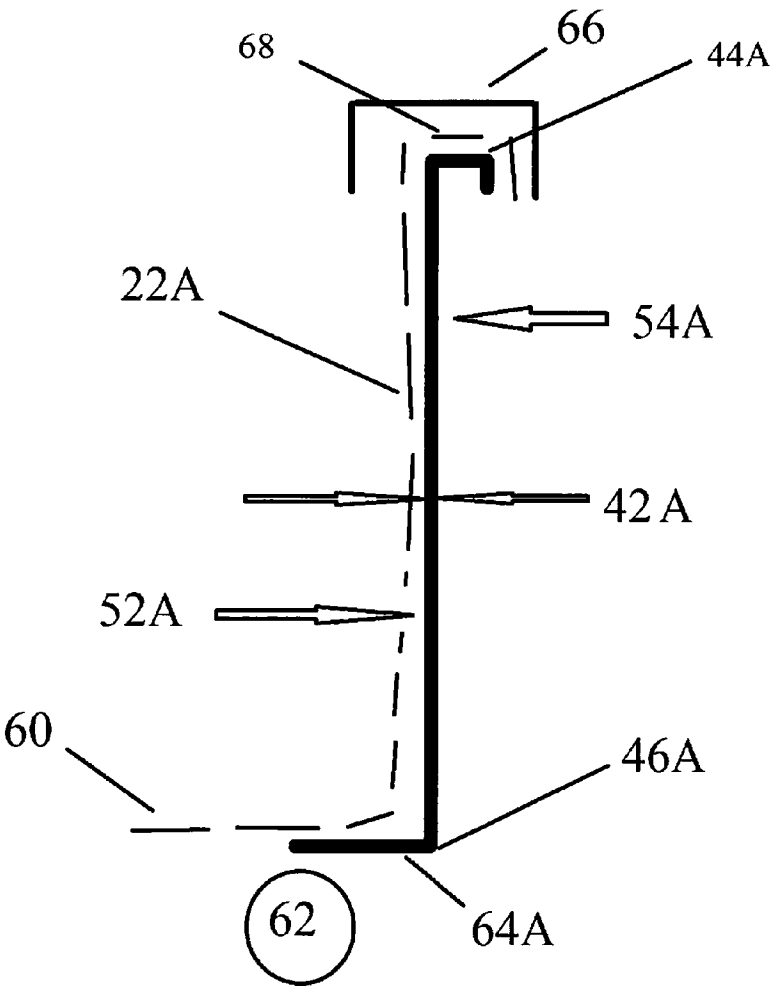
FIG. 3 illustrates a cross-sectional side view of the linear wall panel in FIG. 2 along section A-A of one embodiment of the invention.

Referring to FIG. 3, there is illustrated a cross-sectional side view of one linear panel 22A along section A-A in FIG. 2. The panel has an inside surface 52A and an outside surface 54B. The inside surface is adjacent to a containment sealing membrane 60 (shown as a dashed line) which provides an impermeable seal between whatever liquid is contained within the containment system and the ground 62. Extending from the bottom end 46A of the panel 22A is a horizontal panel 64A. The horizontal panel is integral to the linear panel. Horizontal panel 64A extends inwardly from the bottom edge 46A and perpendicular along the length 38A of the panel 22A. Over the top edge 44A of the panel there is a capping member 66 extending along the length 38 for sealing a top end 68 of the containment sealing membrane 60. In FIG. 3, the dimensions of the capping member are exaggerated so show the relationship between the elements. Naturally, the capping member will have a sealing frictional fit with the top edge of the panel 44A.

Figure 4:
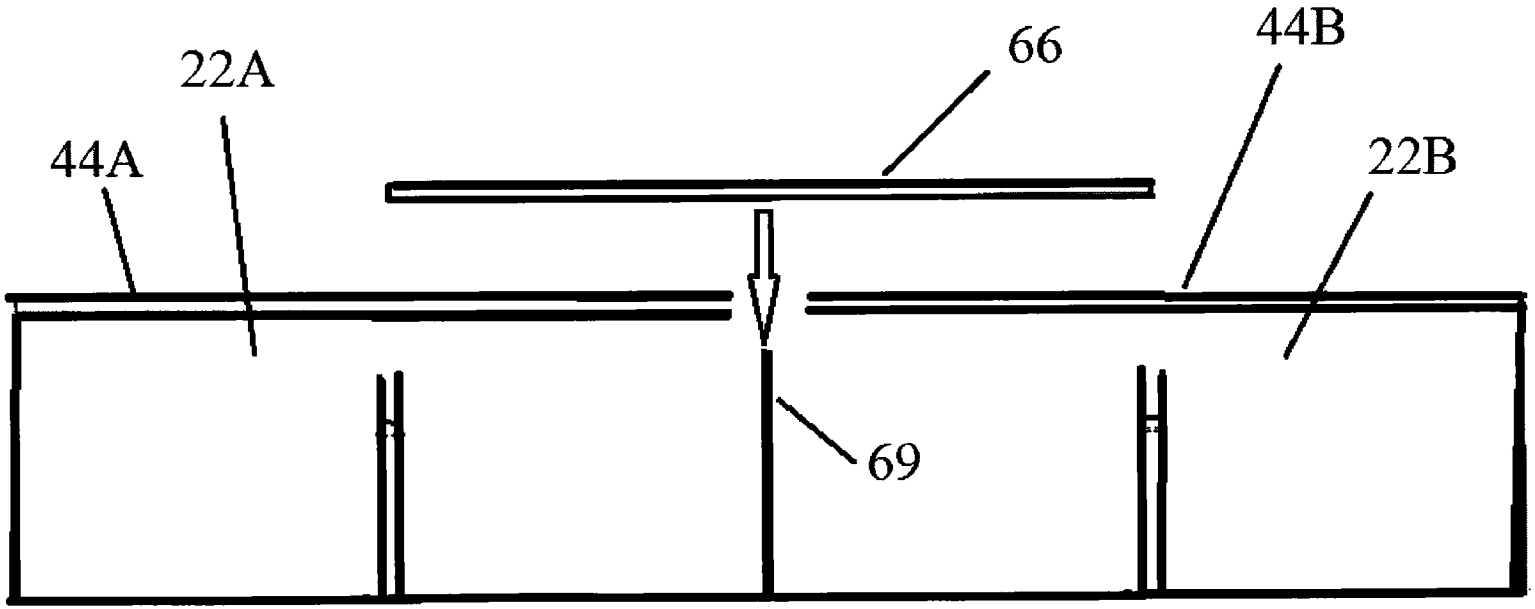
FIG. 4 illustrates a side view of two joined linear wall panels showing installation of the member.

FIG. 4 shows the relationship between the elongate capping member 66 and the wall panels 22A and 22B. The capping member is about the same length of the wall panel and is disposed on the top edge 44AB of the wall members and centred over the junction 69 between two overlapping panels. The capping member is placed over the top edge of the wall panel along the entire perimeter of the wall structure. The placement over the junction 69 of adjacent wall panels adds to the overall stability of the wall structure and does away with the need to fix adjacent wall panels together.

Figure 5:
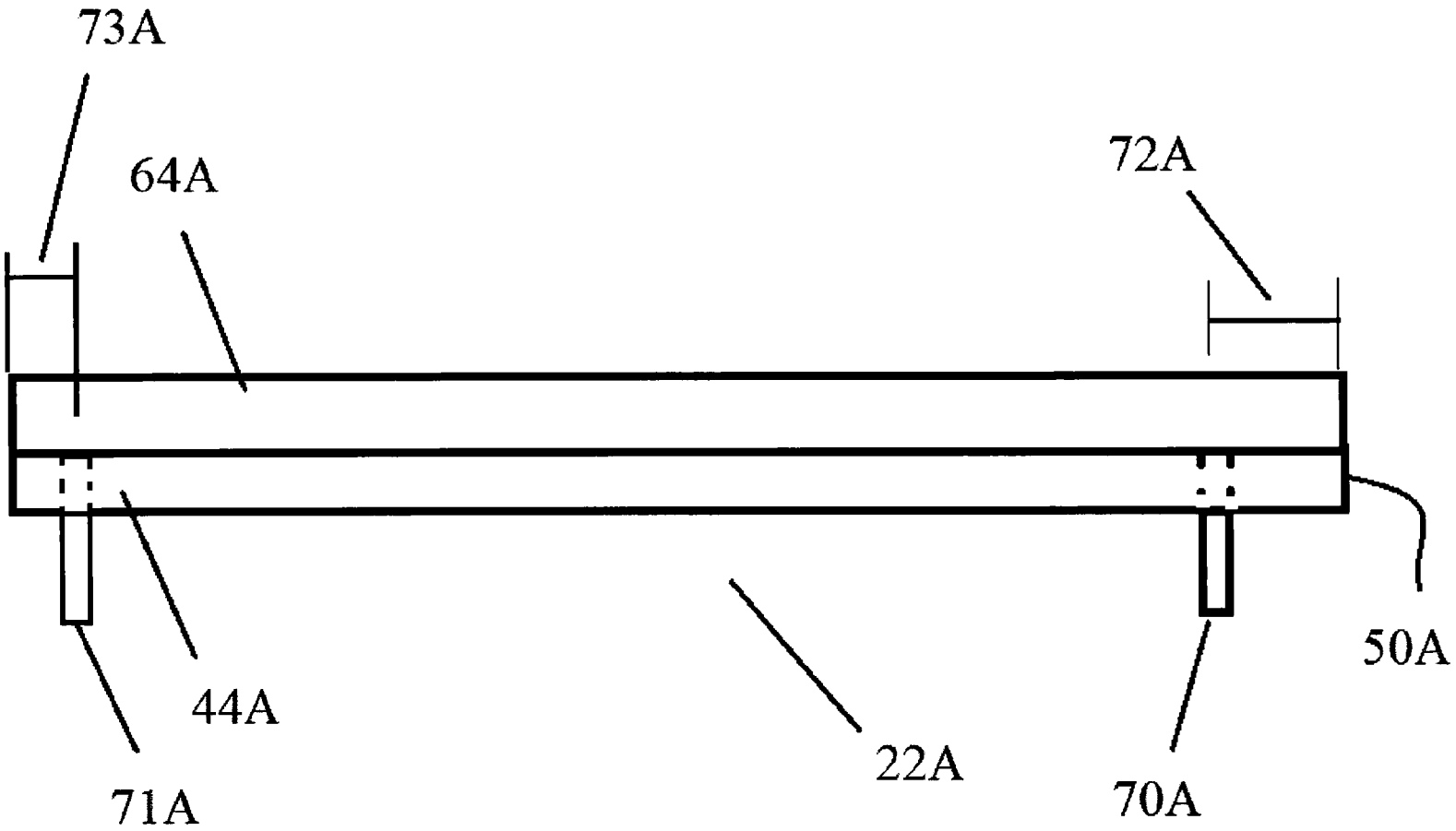
FIG. 5 illustrates a top view of a linear wall panel of one embodiment of the invention.
Figure 6:
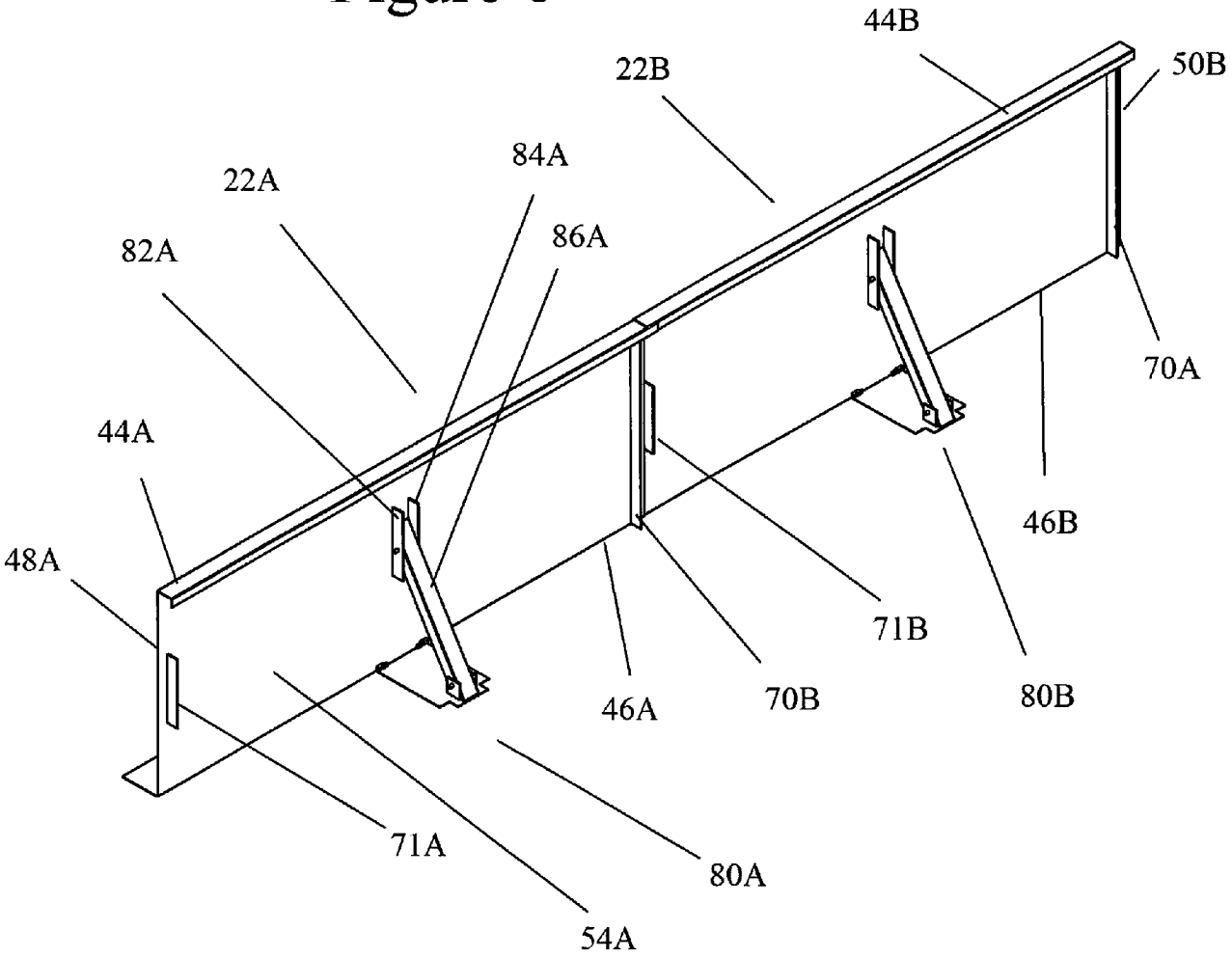
FIG. 6 illustrates a pair of linear wall panels joined in one embodiment of the invention.

Referring to FIG. 5 there is shown a top view of panel 22A. Referring to FIG. 6 there is shown a perspective view of adjacent panels 22A and 22B. A first rib member 70A is disposed a predetermined distance 72A inside the right side edge 50A of the panel. As illustrated in FIG. 6, the rib 70AB extends from the top end 44AB of the panel to the bottom end 46A. The rib member 70AB is adapted to abut the left side edge 48A of a right-adjacent containment barrier panel. A second rib member 71AB is disposed on the outside surface of each wall panel a distance 73AB from the left side edge 48AB of the panel. Rib member 71 AB is centrally disposed on the outside surface of the panel and is about one-third to one-quarter the length of rib 70AB. Rib 71AB and Rib 70AB are intended to stiffen the body of the panel to prevent bulging and warping if and when the reservoir inside of wall begins to fill with a liquid. Rib 71AB abuts against the right-side of the adjacent panel 50A.

Figure 7:
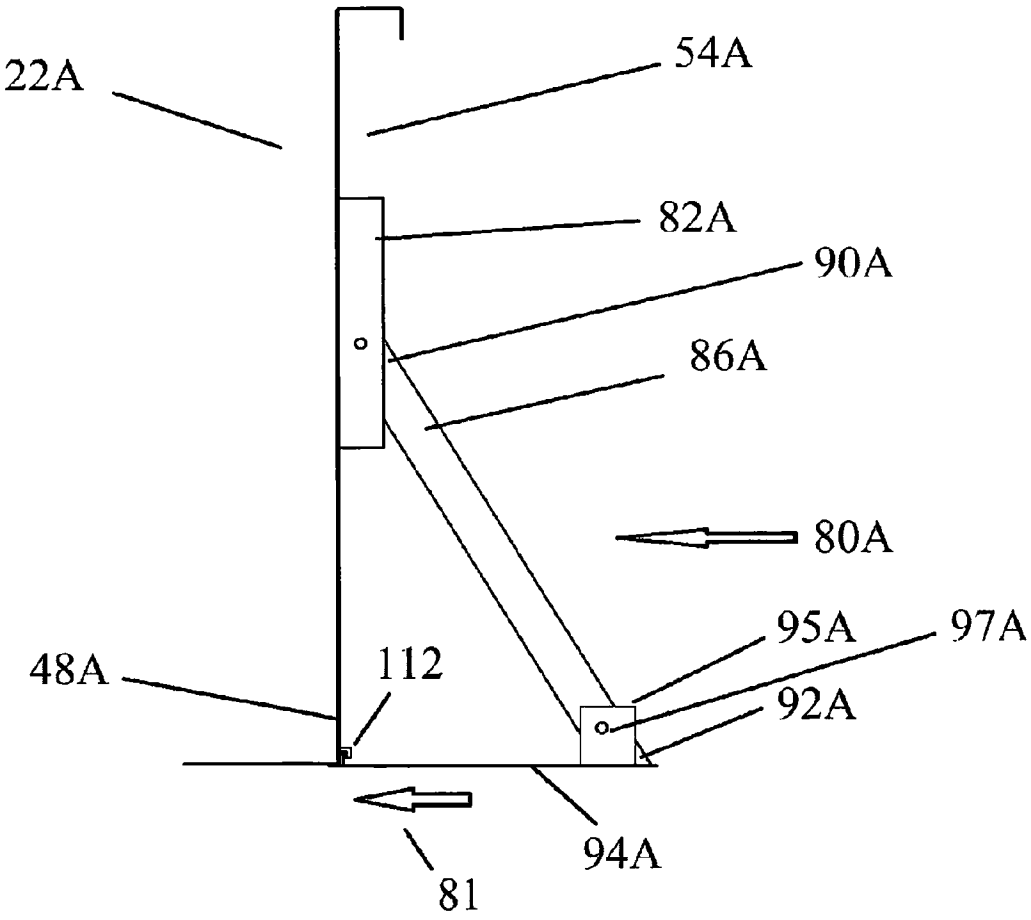
FIG. 7 illustrates a side view of one linear wall panel showing deployment of the support apparatus.
Figure 8:
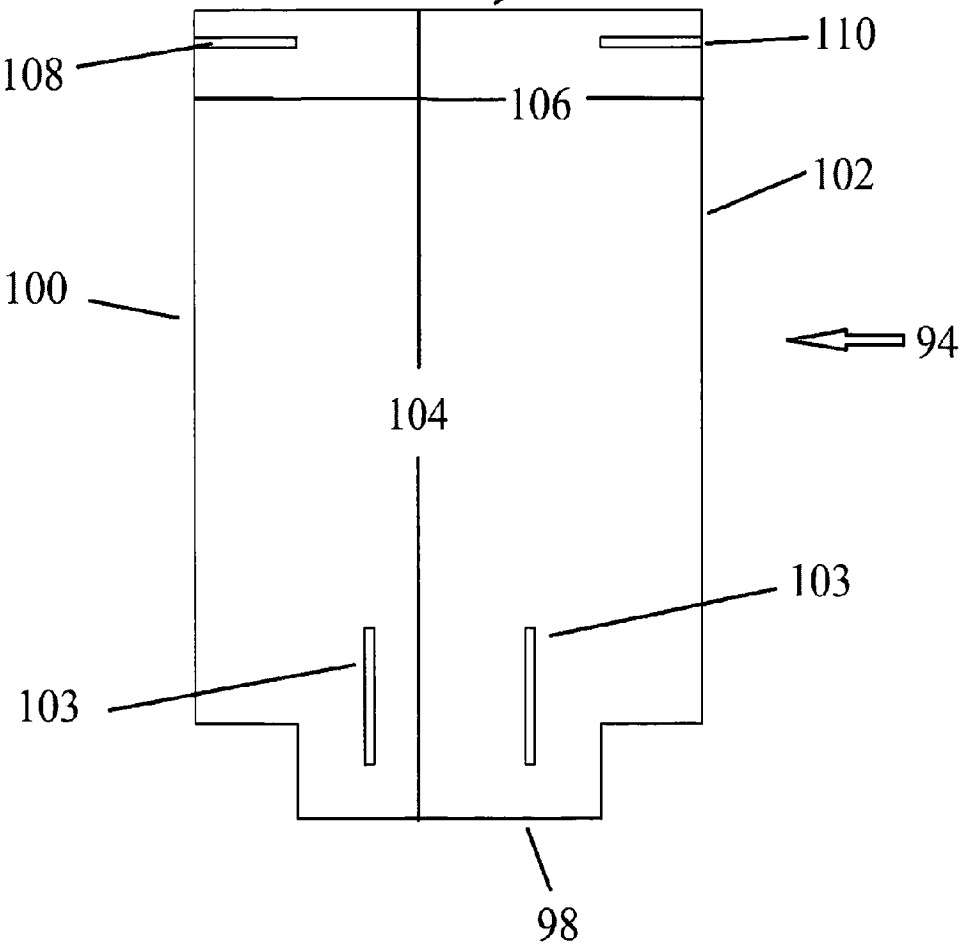
FIG. 8 illustrates a top view of a foot panel of one embodiment of the invention.

Now refer to FIG. 6 and FIG. 7. There is illustrated in FIG. 7 a side view of a panel 22A from the left side edge 48A. FIG. 6 illustrates an outside perspective view of a pair of joined wall panels 22AB. Each of the wall panels 22AB and the corner panels 32 and 34 comprise a retractable foot apparatus shown generally as 80A. The apparatus 80A is fixed centrally to the outside surface 54 of each panel. The retractable foot apparatus comprises a pair 82A and 84A of parallel and spaced-apart bracket members fixed centrally on the outside surface 54A of the panel 22A forming an attachment bracket for a support column 86A. Support column 86A has a first end 90A pivotally attached to the attachment bracket between the bracket members 82A and 84A by a first pin 90A. The pin is fixed in place and is not removable. The second end 92A of the support column 86A is attached to a foot plate 94A by a second bracket 95A and a second permanent pin 97A. As shown in FIG. 8, the second bracket 95A comprises bracket members 101A and 103A.

Referring to FIG. 7 and FIG. 8, there is shown in FIG. 8 a top view of a foot plate of the invention. The foot plate 94 has a first end 96 and a second end 98, a first side 100 and a second side 102, a length 104 and a width 106. When the support column 86 is deployed as illustrated in FIG. 7, the support column second end 92 is fixed to the foot plate second end 98 and disposed approximately a foot plate length 104 away from the outside surface 52 of the panel. A single foot plate 94 provides sufficient ground support and stability to each of the panel. The foot plate 94 has a stored position under the horizontal panel 62 and a deployed position opposite the horizontal panel 62 as illustrated in FIG. 7. The foot plate 94 moves to a storage position under the panel 62 as shown by arrow 81, The foot plate 94 further includes a first upward projection 108 disposed just inside the first end 96 first side 100 corner and a second upward projection 110 disposed within the first end 96 second side 102 corner. FIG. 7 illustrates that the outside surface 54 bottom end 46 of each panel 22 includes a first downward-disposed tab 112 and a second downward-disposed tab 114. The tabs 112 and 114 are fixed to the panel just above the bottom edge 46 of the panel and are spaced apart a distance equal to the distance between the first 108 and the second 110 projections on the foot plate. The tabs 112 and 114 depend downwards so that the first tab 112 engages with the first projection 108 and the second tab 114 engages with the second slot 110 thereby temporarily holding the foot plate 94 in a deployed position. The tabs are easily disengaged from the slots so that the foot plate can side under the panel 64 for storage. When in a storage configuration the support column 86 has a stored position flat against the outside surface 54 of the panel 22.

Figure 9:
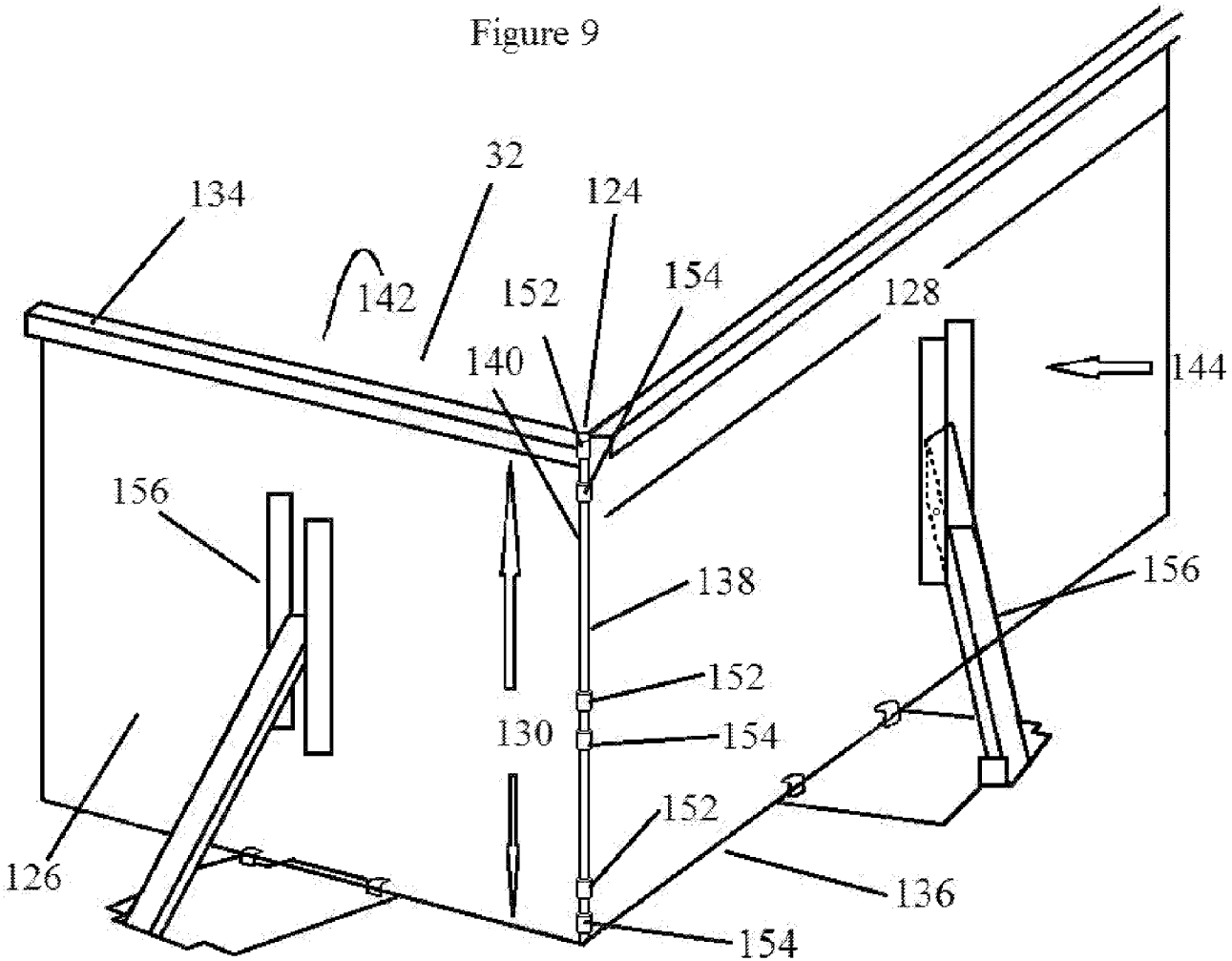
FIG. 9 illustrates a perspective view of a set of corner wall panels joined in embodiment of the invention.

Referring now to FIG. 1 and to FIG. 9, there is shown a corner section of the wall comprising a set of corner panels 32 and 34. The containment system will comprise four sets of corner panels for each of the corners 24, 26, 28 and 30 as shown in FIG. 1. In the embodiment shown in FIG. 1, the four corner panel sets comprise a first corner panel 32 joined at right angles to a second corner panel 34. The first corner panel 32 and said second corner panel 34 are joined by a pinned hinge joint 124. The joint is prevented from pivoting by spot welds placed along the hinge joint. The first corner panel and the second corner panel comprise a generally rectangular elongate body panel 126 having a length 128, a height 130, a thickness (equal to FIG. 3 item 42), a top end 134, a bottom end 136, a left side edge 138 and a right side edge 140, an inside surface 142 and an outside surface 144. As shown in FIG. 3 inside surface 142 is adjacent to a sealing membrane 60. The bottom end 136 includes a horizontal panel 64 as shown in FIG. 3. The bottom panel 64 extends inwardly and perpendicular along the length 128 of the corner panels 32 and 34. The top end 134 includes a sealing cap extending along length 128 for sealing the top end of the sealing membrane 60 over the top edge 134 of the corner panel similar to the sealing cap for the linear panels. On corner panel 32 there is installed a first plurality of pin receiving sleeves 152 fixed to the right edge 140 and equally spaced along the right edge.

On corner panel 34 there is a second plurality of pin receiving members 154 spaced equally along the left edge 138 of the panel. A retractable foot apparatus 156 is fixed centrally on the outside surface 144 of each panel.

When the linear and corner panels are deployed they are free standing and stable.

Referring to FIG. 1 and FIG. 2, the wall 10 is assembled from duplicate adjacent ones 22A and 22B of the linear panel. The panels are arranged in edge-standing side-by-side relationship as illustrated in FIG. 2 and engaged with one another in an overlapping relationship. The result is that the left side edge 48B of the right-adjacent linear panel 22B abuts the rib member 70A of the left-adjacent linear panel 22A and the right side edge 50A of the left-adjacent linear panel 22A overlaps panel 22B and abuts the rib member 71B. The corner panels are joined as previously explained by a pin hinge and corner panels are engaged with linear panels in the same overlapping relationship as between two linear panels.

A method for constructing a rectangular liquid containment system is also disclosed in this invention. As shown in FIG. 1, such a containment system may be placed around a central point such as an oil storage tank 15. The system comprises a plurality of duplicate linear wall panels 22 for each side of the rectangular liquid containment system 12 and four corner panel sets for each corner of the rectangular containment system. The linear and corner panels are configured as described herein. The method of construction comprises the steps of:

1. Arranging a plurality of duplicate linear wall panels 22 and four corner panels sets around an area 8 to be enclosed by the rectangular liquid containment system 10;
2. Forming the four corners 24, 26, 28 and 30 of the containment system by pinning each of the first corner panels 32 to an adjacent second corner panel 34 using pin hinge 124;
3. Deploying the corner panel 32 and 34 retractable foot apparatus 156;
4. Sliding a first linear wall panel 22 left side edge 48 in an overlapping relationship with a second corner panel right side 141 so the said linear wall panel left side edge 48 abuts the second corner panel 34 right side rib 70 and so that the second corner panel 32 right side edge 141 engages the slot 76 in the key member 74 of the linear wall panel left side 48;
5. Deploying the first linear wall panel 22 retractable foot apparatus 80;
6. Repeating steps IV and V above until a desired wall length is obtained;
7. Placing the containment sealing member 60 within the enclosed area 8 so that the containment sealing member is adjacent the inside surfaces of the wall linear and corner panels;
8. Draping the edges 68 of the containment sealing member 60 over the top edges of the linear wall panels and corner panel sets;
9. Placing the sealing cap over the top edges of the panels.

Although the description above contains much specificity, these should be construed as limiting the scope of the embodiments of the invention but as merely providing illustrations of some of the several embodiments. Thus the scope of the invention should be determined by the appended claims and their legal equivalents.

What is claimed is:

1. A temporary wall for a rectangular liquid containment system, said wall comprising four sides, at least one linear panel per side and four corner panel sets, said at least one linear panel comprising:

a. a generally rectangular elongate body having a length, a height, a thickness, a top end, a bottom end spaced-apart from the top end, a left side edge, a right side edge spaced-apart from the left side, an inside surface and an outside surface spaced-apart from the inside surface; wherein, b. said inside surface is adjacent to a containment sealing membrane;

c. said bottom end includes a horizontal panel extending inwardly therefrom and perpendicular along said length;

d. said top end includes a sealing member extending along the length for sealing a top end of said containment sealing membrane thereto;

e. a first rib member is disposed a first distance inside said right side edge and extending from the top end to the bottom end, said first rib member adapted to abut a left side edge of an right-adjacent containment barrier panel;

f. a second rib member is disposed a second distance inside said left side edge of said body and approximately midway between the top end and the bottom end, said first and second rib members being for stiffening said body; and g. a retractable foot apparatus is fixed centrally on said outside surface.

2. The wall of claim 1 wherein adjacent ones of the linear panels can be arranged in edge-standing side-by-side relationship and engaged with one another in an overlapping relationship so that the left side edge of a right-adjacent one of the linear panels abuts the rib first member of a left-adjacent one of the linear panels and so that the right side edge of the left-adjacent one of the linear panels abuts the rib member of the right-adjacent one of the linear panels.

3. The wall of claim 1 wherein said retractable foot device comprises a pair of parallel and spaced bracket members fixed centrally on the outside surface forming an attachment bracket for a support column, the support column having a first end permanently pinned and pivotally attached to said attachment bracket and having a second end permanently pinned and pivotally attached to a foot plate.

4. The wall of claim 3 wherein said foot plate has a first end and a second end spaced-apart therefrom, a first side, a second side spaced-apart from its first side, a length and a width so that when said support column is deployed said second end of the support column is pivotally fixed to said second end of the foot plate and disposed a foot plate length away from the outside surface.

5. The wall of claim 4 wherein the foot plate has a first stored position under said horizontal panel and a second deployed position opposite the horizontal panel.

6. The wall of claim 5 wherein the foot plate further includes a first projection disposed adjacent to the first end of the foot plate at a location adjacent to a first side corner of the foot plate and wherein the foot plate further includes a second projection disposed adjacent to the first end of the foot plate at a location adjacent to a second side corner of the foot plate which is spaced-apart from said first side corner of the foot plate.

7. The wall of claim 6 wherein the elongate body includes a first tab and a second tab space-apart from the first tab, the tabs being positioned at the outside surface of the body adjacent to the bottom end thereof, each of the tabs comprising a first horizontal portion and a second vertical portion depending from said first horizontal portion, said first tab being adapted to engage said first projection and said second tab being adapted to engage said second projection thereby temporarily holding the foot plate in said second deployed position.

8. The wall of claim 7 wherein the support column has a stored position flat against the outside surface of the elongate body.

9. The wall of claim 1 where each of said four corner panel sets comprises a first corner panel joined at a right angle to a second corner panel.

10. The wall of claim 9 wherein said first corner panels and said second corner panels are joined respectively by a pinned hinge joint.

11. The wall of claim 10 wherein the first corner panel comprises:

a. a generally rectangular elongate body having a length, a height, a thickness, a top end, a bottom end, a left side edge, a right side edge, an inside surface and an outside surface; wherein, b. said inside surface is adjacent to a sealing membrane;

c. said bottom end includes a horizontal panel extending inwardly therefrom and perpendicular along said length;

d. said top end receives a sealing member extending along said length for sealing a top end of said sealing membrane thereto;

e. a first plurality of pin receives sleeves fixed to said right side edge and equally spaced along the right side edge; and f. a retractable foot device is fixed centrally on said outside surface.

12. The wall of claim 11 wherein the second corner panel comprises:

a. a generally rectangular elongate body having a length, a height, a thickness, a top end, a bottom end, a left side edge; a right side edge, an inside surface and an outside surface; wherein, b. the inside surface is adjacent to a sealing membrane;

c. the bottom end includes a horizontal panel extending inwardly therefrom and perpendicular along said length;

d. the top end receives a sealing member extending along the length for sealing a top end of said sealing membrane thereto;

e. a second plurality of pin receiving sleeves fixed to the left edge and equally spaced along the left edge; and f. a retractable foot device is fixed centrally on said outside surface.

13. The wall of claim 9 wherein, when deployed, the at least one linear panel and the at least two corner panels are free-standing.

* * * * *